US009777995B2

(12) United States Patent
Ranat et al.

(10) Patent No.: US 9,777,995 B2
(45) **Date of Patent: *Oct. 3, 2017**

(54) SYSTEM AND METHOD FOR DISPLAYING WEAPON ENGAGEMENT FEASIBILITY

(71) Applicant: BAE Systems plc, London (GB)

(72) Inventors: Bhadrayu Manherlal Ranat, Warton (GB); Monadl Abd Al-Abbas Mansour Al-Ameri, Warton (GB)

(73) Assignee: BAE SYSTEMS PLC, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 15/037,367

(22) PCT Filed: Nov. 14, 2014

(86) PCT No.: PCT/EP2014/074615

§ 371 (c)(1),
(2) Date: May 18, 2016

(87) PCT Pub. No.: WO2015/074967

PCT Pub. Date: May 28, 2015

(65) Prior Publication Data

US 2016/0298931 A1 Oct. 13, 2016

(30) Foreign Application Priority Data

Nov. 25, 2013 (EP) ..... 13275288
Nov. 25, 2013 (GB) ..... 1320764.2

(51) Int. Cl.
*G06F 19/00* (2011.01)
*F41G 7/00* (2006.01)
(Continued)

(52) U.S. Cl.
CPC ..... *F41G 7/007* (2013.01); *F41G 3/22* (2013.01); *F41G 9/002* (2013.01)

(58) Field of Classification Search
CPC ..... F41J 5/06; F41J 5/12; F41J 5/14
(Continued)

(56) References Cited

U.S. PATENT DOCUMENTS 6,658,980 B1 12/2003 Hayes et al.
7,599,765 B2 10/2009 Padan
(Continued)

FOREIGN PATENT DOCUMENTS

WO 2011018656 A2 2/2011

OTHER PUBLICATIONS

International Preliminary Report on Patentability of PCT Appl No. PCT/EP2014/074615, dated May 31, 2016, 10 pages.
(Continued)

*Primary Examiner* — Daniel St Cyr
(74) *Attorney, Agent, or Firm* — Maine Cernota & Rardin

(57) ABSTRACT

Disclosed is a system and method for generating, in an aircraft (1) in flight, a display indicative of the feasibility of a weapon carried on the aircraft (1) successfully engaging a determined target (5, T) and/or the feasibility of a weapon carried on the target (5, T) successfully engaging the aircraft (1). The method comprises: using a performance envelope of the weapon and performance envelope(s) for one or more different types of aircraft (1), determining a further performance envelope specifying the performance of the weapon when carried by any of the different aircraft (1) types; determining coefficients for a generic polynomial that fit the generic polynomial to the further performance envelope; uploading, to the aircraft (1), the generated coefficients; and, on the aircraft (1), reconstructing the further performance envelope and generating the feasibility display.

15 Claims, 4 Drawing Sheets

(51) Int. Cl.
*F41G 3/22* (2006.01)
*F41G 9/00* (2006.01)

(58) Field of Classification Search
USPC ..... 235/400, 406, 408, 410, 405, 403, 404
See application file for complete search history.

(56) References Cited

U.S. PATENT DOCUMENTS

| | | | | |
|---|---|---|---|---|
| 8,038,541 | B1 * | 10/2011 | Solomon | A63G 1/00 472/1 |
| 8,783,567 | B2 * | 7/2014 | Ranat | F41G 3/22 235/400 |
| 2008/0018525 | A1 * | 1/2008 | Svy | G01S 7/024 342/169 |

OTHER PUBLICATIONS

PCT Search Report and Written Opinion for PCT Application No PCT/EP2014/074615, dated Jan. 29, 2015, 14 pages.
EP Search Report for EP Application No. EP13275288.2, dated Apr. 17, 2014, 9 pages.
GB Combined Search and Examination Report for GB Application No. GB1320764.2, dated May 12, 2015, 6 pages.
Clark D et al, "Common Launch Acceptability Region Task Group", SAE World Aviation Congress—Proceedings of the 2001 Aerospace Congress, Seattle, USA, No. 2001-01-2953, Oct. 14, 2001, pp. 1-10.

* cited by examiner

SYSTEM AND METHOD FOR DISPLAYING WEAPON ENGAGEMENT FEASIBILITY

RELATED APPLICATIONS

This application is a national phase application filed under 35 USC §371 of PCT Application No. PCT/EP2014/074615 with an International filing date of Nov. 14, 2014 which claims priority of GB Patent Application 1320764.2 filed Nov. 25, 2013 and EP Patent Application 13275288.2 filed Nov. 25, 2013. Each of these applications is herein incorporated by reference in its entirety for all purposes.

FIELD OF THE INVENTION

This invention relates to the integration of systems and, more particularly, to the integration of weapons on complex, highly integrated aircraft.

BACKGROUND

Integration of a weapon system with the other systems on an aircraft is a complex and lengthy task, as it affects all the major aircraft systems. Accordingly there is a requirement to improve weapon integration time and affordability.

One of the requirements of weapon integration is to enable the display of information to the aircraft pilot as to whether or not a weapon is capable of successfully engaging a particular target. For this purpose, weapons are usually grouped into two categories, weapons designed to engage targets on the ground (air to ground weapons) and weapons designed to engage targets in the air (air to air weapons). In the case of air to ground weapons, a Launch Acceptability Region (LAR) is calculated, being the region where the probability of successfully engaging or hitting a selected target is above some threshold value. The LAR is calculated in order to provide cockpit displays in the launch aircraft indicating the feasibility of successfully engaging the target, and is a function of the weapon performance characteristics, the relative positions and motions of the aircraft and the target, and often ambient conditions such as wind speed and direction.

For an air to air weapon, a Launch Success Zone (LSZ) is calculated, indicative of the probability of successfully engaging a selected air target being above some threshold value. Again the LSZ is used to provide a cockpit display indicating whether the weapon is capable of successfully engaging the target. However, calculation of an LSZ is more complicated than the calculation of an LAR because the relative speeds and directions of travel of the launch aircraft and the target are much greater, the effects of ambient conditions are greater, and also the physical properties of the weapons in flight are more significant on the calculation.

The conventional approach has been to create a simple, abstract model of the weapon, which is modified according to the launch conditions (taking into account the aircraft and target conditions (e.g. range, direction and speed of travel, etc.) and the ambient conditions). The model is used on board the aircraft to generate the LAR or LSZ for display to the pilot. A disadvantage of the conventional approach is that each model, for each different weapon type, is different. Storing the data relating to several different implicit models consumes significant storage capacity, and each model has to be comprehensively integrated to ensure that there is no adverse effect on any of the aircraft systems. Further, if there are any changes or modifications made to a weapon (such as an improvement in performance) or if it is necessary to load the aircraft with a completely new weapon, a lengthy and expensive integration process has to be conducted because the weapon model is substantially different to anything previously integrated with the aircraft systems.

SUMMARY OF THE INVENTION

In a first aspect, the present invention provides a method for generating, in an aircraft in flight, a display indicative of the feasibility of a weapon carried on the aircraft successfully engaging a determined target and/or the feasibility of a weapon carried on the target successfully engaging the aircraft. The method comprises: acquiring, by one or more processors, a respective performance envelope for one or more different types of aircraft, the one or more processors being remote from the aircraft; using the one or more aircraft performance envelopes, determining, by the one or more processors, a (single) performance envelope defining the performance of all of the different aircraft types; acquiring, by the one or more processors, a performance envelope for the weapon; using the performance envelope that is representative of the performance of all of the different aircraft types and the weapon performance envelope, determining, by the one or more processors, a (single) further performance envelope, the further performance envelope defining the weapon's performance when that weapon is implemented on each of the different aircraft types, the further performance envelope being the minimum envelope that defines the weapon's performance when that weapon is implemented on each of the different aircraft types; determining, by the one or more processors, coefficients for a generic polynomial that fit the generic polynomial to the further performance envelope; uploading, to the aircraft, the generated coefficients; reconstructing, on the aircraft, the further performance envelope using the same generic polynomial; and, using aircraft and target conditions and the reconstructed further performance envelope, generating, on the aircraft, the feasibility display.

The step of acquiring a respective performance envelope for one or more different types of aircraft may comprise acquiring a respective performance envelope for a plurality of different types of aircraft.

The generic polynomial may be of the form:

$$y_n = \sum_{m=1}^{M_n} \alpha_{mn} x_1^{p_{1mn}} x_2^{p_{2mn}} \ldots$$

where:

$\alpha_{mn}$ represent the m coefficients required to compute output n;

$\{x_1 \ldots x_{Ni}\}$ represent the normalised inputs; and $\{y_1 \ldots y_{Nj}\}$ represent the outputs.

The order of the generic polynomial may be three or greater. The order of the generic polynomial may be between 10 and 25. The order of the generic polynomial may be 20.

The step of generating the coefficients may comprise: a) generating an initial population of candidate polynomials; b) for each candidate polynomial, computing a set of coefficients which fit that polynomial to the further performance envelope according to one or more criteria; and c) for each candidate polynomial and respective set of coefficients, computing a score function indicative of the quality of the fit of that candidate polynomial and that set of coefficients to the further performance envelope; and d) recursively applying a genetic algorithm to the set of candidate polynomials until one or more criteria are met, including retaining at least the best scoring polynomial and discarding the other polynomial(s). The outputs of the retained polynomial(s) may be a layer of a Self-Organising Polynomial Neural Network and are used to provide inputs for creating higher order candidate polynomials. These steps may be iterated on the higher order candidate polynomials. A final result may be obtained from the path ending with the best candidate score.

The target may be a further aircraft. The feasibility display may be indicative of a Launch Success Zone of the aircraft and/or the target.

The target may be a ground based target. The feasibility display may be indicative of a Launch Acceptability Region of the aircraft and/or a Missile Engagement Zone of the target.

In a further aspect, the present invention provides a system for generating in an aircraft in flight a display indicative of the feasibility of a weapon carried on the aircraft successfully engaging a determined target and/or the feasibility of a weapon carried on the target successfully engaging the aircraft. The system comprises: one or more processors remote from the aircraft and configured to: acquire a respective performance envelope for one or more different types of aircraft; using the one or more aircraft performance envelopes, determine a performance envelope defining the performance of all of the different aircraft types; acquire a performance envelope for the weapon; using the performance envelope that is representative of the performance of all of the different aircraft types and the weapon performance envelope, determine a further performance envelope, the further performance envelope defining the weapon's performance when that weapon is implemented on each of the different aircraft types, the further performance envelope being the minimum envelope that defines the weapon's performance when that weapon is implemented on each of the different aircraft types; and determine coefficients for a generic polynomial that fit the generic polynomial to the further performance envelope; an uploader operatively coupled to the one or more processors and configured to upload, to the aircraft, the generated coefficients; and a reconstructor on-board the aircraft and configured to: reconstruct the further performance envelope using the same generic polynomial; and, using aircraft and target conditions and the reconstructed further performance envelope, generate, on the aircraft, the feasibility display.

The one or more processors may be configured to acquire a respective performance envelope for a plurality of different types of aircraft.

In a further aspect, the present invention provides an aircraft comprising a system according to the preceding aspect.

In a further aspect, the present invention provides a method for generating, in an aircraft in flight, a display indicative of the feasibility of a weapon carried on the aircraft successfully engaging a determined target and/or the feasibility of a weapon carried on the target successfully engaging the aircraft, the method comprising: acquiring, by one or more processors, a respective performance envelope for one or more different types of aircraft, the one or more processors being remote from the aircraft; acquiring, by the one or more processors, a performance envelope for the weapon; determining, by the one or more processors, using the performance envelope of the weapon and the performance envelope(s) for the one or more different types of aircraft, a further performance envelope specifying the performance of the weapon when carried by any of the different aircraft types; determining, by the one or more processors, coefficients for a generic polynomial that fit the generic polynomial to the further performance envelope; uploading, to the aircraft, the generated coefficients; reconstructing, on the aircraft, the further performance envelope using the same generic polynomial; and, using aircraft and target conditions and the reconstructed further performance envelope, generating, on the aircraft, the feasibility display.

The one or more processors may be located remotely from the aircraft.

The generic polynomial may be of the form:

$$y_n = \sum_{m=1}^{M_n} \alpha_{mn} x_1^{p1mn} x_2^{p2mn} \ldots$$

where:

$\alpha_{mn}$ represent the m coefficients required to compute output n;

$\{x_1 \ldots x_{Ni}\}$ represent the normalised inputs; and $\{y_1 \ldots y_{Nj}\}$ represent the outputs.

Preferably, the order of the generic polynomial is three or greater. More preferably, the order of the generic polynomial is between 10 and 25. More preferably, the order of the generic polynomial is 20.

The step of generating the coefficients may comprise: generating an initial population of candidate polynomials; for each candidate polynomial, computing a set of coefficients which fit that polynomial to the further performance envelope according to one or more criteria (e.g. a least squares criterion); for each candidate polynomial and respective set of coefficients, computing a score function indicative of the quality of the fit of that candidate polynomial and that set of coefficients to the further performance envelope; and recursively applying a genetic algorithm to the set of candidate polynomials until one or more criteria are met, including retaining at least the best scoring polynomial and discarding the other polynomial(s). The outputs of the retained polynomial(s) may be a layer of a Self-Organising Polynomial Neural Network and are used to provide inputs for creating higher order candidate polynomials. These steps may be iterated until a final result having the best candidate score is obtained.

The step of determining the further performance envelope may comprise using the plurality of aircraft performance envelopes, determining a performance envelope defining the performance of all of the different aircraft types (i.e. a "maximum aircraft performance envelope"), and, using the performance envelope that is representative of the performance of all of the different aircraft types and the weapon performance envelope, determining a performance envelope defining the weapon's performance when that weapon is implemented on each of the different aircraft types. Preferably, the further performance envelope is the minimum sized envelope that defines the weapon's performance when that weapon is implemented on each of the different aircraft types.

The step of uploading, to the aircraft, the generated coefficients may be performed when the weapon is loaded as an aircraft store. When loading a new weapon store, to integrate the weapon and aircraft aiming system, the coefficients associated with that weapon may be uploaded to the aircraft at the same time as the weapon. Preferably, the coefficients are stored on a hardware device with the weapon, and the device is connected to the aircraft to upload the coefficient data as the weapon is loaded.

The target may be a further aircraft and the feasibility display may be indicative of a Launch Success Zone of the aircraft and/or the target.

Alternatively, the target may be a ground based target and the feasibility display may be indicative of a Launch Acceptability Region of the aircraft and/or a Missile Engagement Zone of the target.

In a further aspect, the present invention provides a system for generating in an aircraft in flight a display indicative of the feasibility of a weapon carried on the aircraft successfully engaging a determined target and/or the feasibility of a weapon carried on the target successfully engaging the aircraft, the system comprising: one or more processors remote from the aircraft and configured to: acquire a respective performance envelope for one or more different types of aircraft, acquire a performance envelope for the weapon, determine, using the performance envelope of the weapon and the performance envelope(s) for the one or more different types of aircraft, a further performance envelope specifying the performance of the weapon when carried by any of the different aircraft types, and determine coefficients for a generic polynomial that fit the generic polynomial to the further performance envelope; an uploader operatively coupled to the one or more processors and configured to upload, to the aircraft, the generated coefficients; and a reconstuctor onboard the aircraft and configured to reconstruct the further performance envelope using the same generic polynomial, and, using aircraft and target conditions and the reconstructed further performance envelope, generate, on the aircraft, the feasibility display.

In a further aspect, the present invention provides an aircraft comprising a system according to the preceding aspect.

In a further aspect, the present invention provides a program or plurality of programs arranged such that when executed by a computer system or one or more processors it/they cause the computer system or the one or more processors to operate in accordance with the method of any of the above aspects.

In a further aspect, the present invention provides a machine readable storage medium storing a program or at least one of the plurality of programs according to the preceding aspect.

The provided methods and systems tends to significantly improve weapon integration time and cost.

A minimal number of generic weapon aiming algorithms may be used in order to take account of all weapon types.

The method can be used for different weapon types, and a respective set of coefficients may be easily determined for each weapon type e.g. for each of a plurality of different firing conditions (i.e. aircraft and target conditions). These aircraft and target conditions may include but are not limited to one or more of their relative positions, distances, directions of movement, speeds and ambient atmospheric conditions.

In some aspects, a database is generated by: defining the range of conditions for which the weapon may be required to be fired, the range of aircraft conditions for which it is feasible for the aircraft to fire the weapon and the range of weapon conditions for which it is feasible to fire the weapon; generating data indicative of the weapon performance for each weapon firing possibility from within the defined ranges; and creating a database defining the weapon's overall performance envelope. The coefficients may then be determined from this database and the generic polynomial. In this way the database can be generated on a ground-based system, so that the aircraft system needs the capacity only to store the generic polynomial and process the coefficients with the aircraft and target conditions in order to generate the feasibility display. Thus, the amount of data storage/processing capacity required on the aircraft tends to be reduced.

The coefficients can be implemented as loadable data so as to allow accurate and precise weapon behaviour to be implemented within the weapon system. Also, using one or only a few generic algorithms would allow different weapon systems to be cleared or certificated/qualified for use with the aircraft with reduced effort and more quickly than with the extensive testing which is required with conventional approaches.

The use of generic algorithms for weapon aiming also enables increases or significant changes in weapon system capability to be integrated with the aircraft systems with significantly less effort than heretofore.

By determining a feasibility of a weapon carried on the target successfully engaging the aircraft, it is displayed whether or not, or to what extent, the aircraft is at risk of being successfully engaged by a weapon carried by a hostile target. This calculation of opposing LSZs/MEZs and allows better assessment of engagements. This in turn could lead to confident predictions of advantage and likely outcome of engagements.

Advantageously, the above aspects provide a generic polynomial/algorithm that may be used (e.g. simultaneously) by multiple different types of aircraft. Different types of aircraft may use the same generic algorithm to calculate LARs/LSZs. Also, the same generic algorithm may be used to calculate LARs/LSZs for different weapon types. Thus, aircraft software comprising the generic polynomial and means for allowing loading of coefficients for each weapon loaded on aircraft is produced only once. The software algorithm and coefficients, for any given weapon, are the same for any aircraft type. This tends to be different to conventional methodologies in which, although common tools may be used for polynomial and coefficient generation, both the software (including an algorithm/polynomial) and coefficients are generated for every weapon type and every time the weapon performance is changed. This need to rewrite the software and the certification of it tends to be particularly costly. The above described method and system advantageously tend to provide that the aircraft software does not have to be rewritten and hence no new certification is required.

In a further aspect the present invention provides a fleet of aircraft comprising a plurality of different aircraft. Each aircraft within the fleet comprises the same, common generic polynomial. When a weapon is loaded onto an aircraft in the fleet, the specific coefficients corresponding to that weapon may also be loaded onto that aircraft. This tends to be in contrast to conventional systems in which, when a weapon is loaded onto an aircraft, both a polynomial/algorithm and corresponding coefficients for generating LAR/LSZs are generated for that aircraft and weapon load-out.

BRIEF DESCRIPTION OF THE DRAWINGS

An embodiment of the invention will now be described by way of example and with reference to the accompanying drawings, in which.

DETAILED DESCRIPTION

Figure 1A:
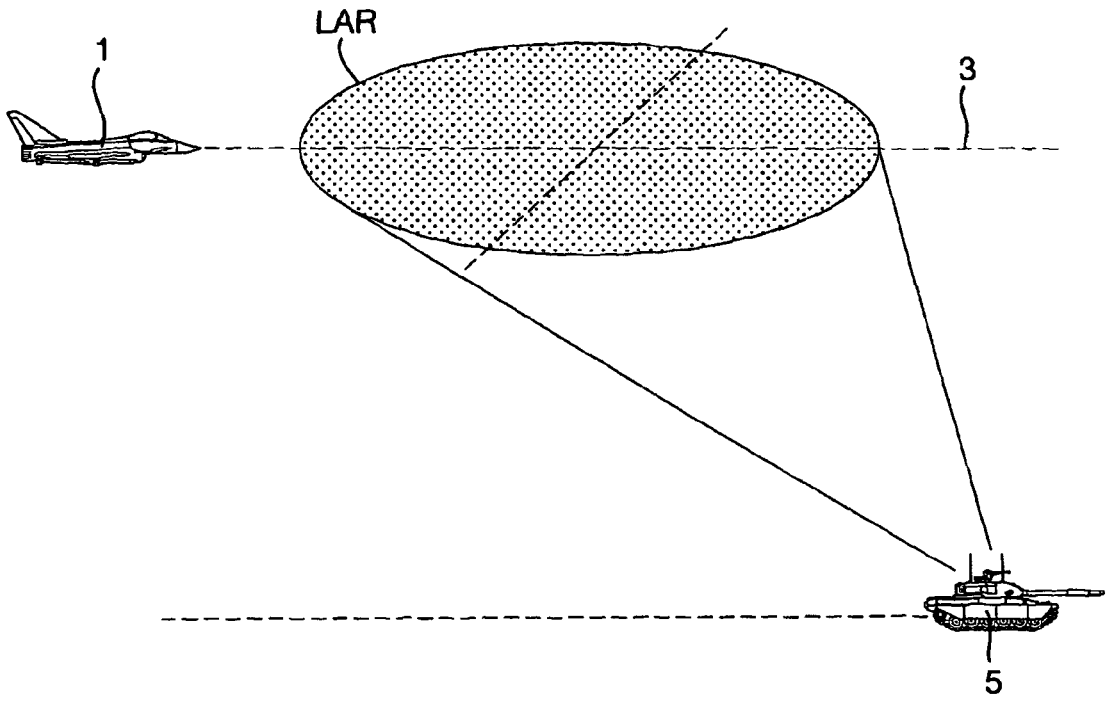
FIGS. 1*a* and 1*b* illustrate the Launch Acceptability Region (LAR) for an air to surface weapon.
Figure 1B:
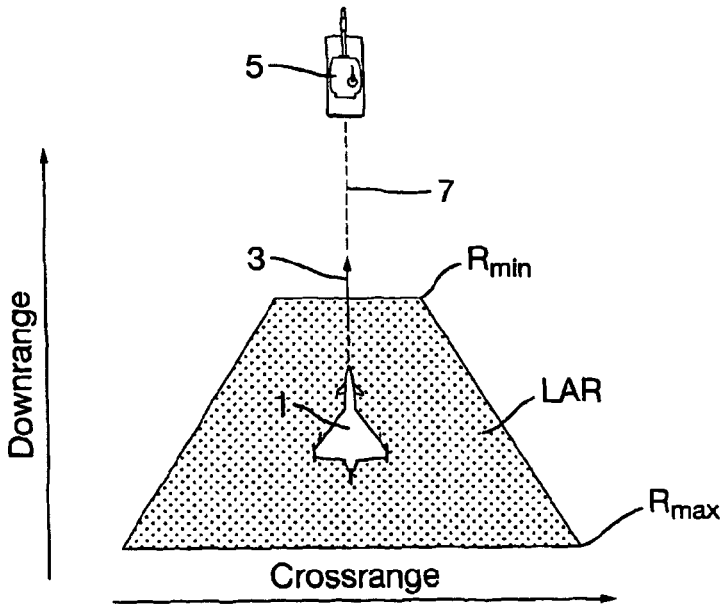

FIG. 1*a* shows the LAR in the plane of flight of a launch aircraft 1 flying along a flight path 3 in respect of a target 5 for an air to surface weapon (not shown) loaded on the aircraft. The LAR is calculated to provide cockpit displays in the launch aircraft 1 concerning the feasibility and firing opportunities for the situation. FIG. 1*b* shows the display generated for the LAR of FIG. 1*a*, which is in the form of a downrange and cross range display (the shaded area), where the weapon flight path 7 coincides with the aircraft flight path 3; to successfully engage the target 5 as shown in the display, the target must fall inside the shaded LAR. As the aircraft 1 moves in the downrange direction, the displayed LAR is bounded by the minimum and maximum ranges, $R_{min}$ and $R_{max}$.

In addition to the LAR for the launch aircraft 1, a Missile Engagement Zone (MEZ) for the target 5 may be determined and displayed to the pilot of the aircraft 1. This MEZ may indicate a region in which the likelihood of a ground-to-air weapon (e.g. a missile) carried by the target 5 successfully intercepting the aircraft 1 is above a threshold value.

Figure 2:
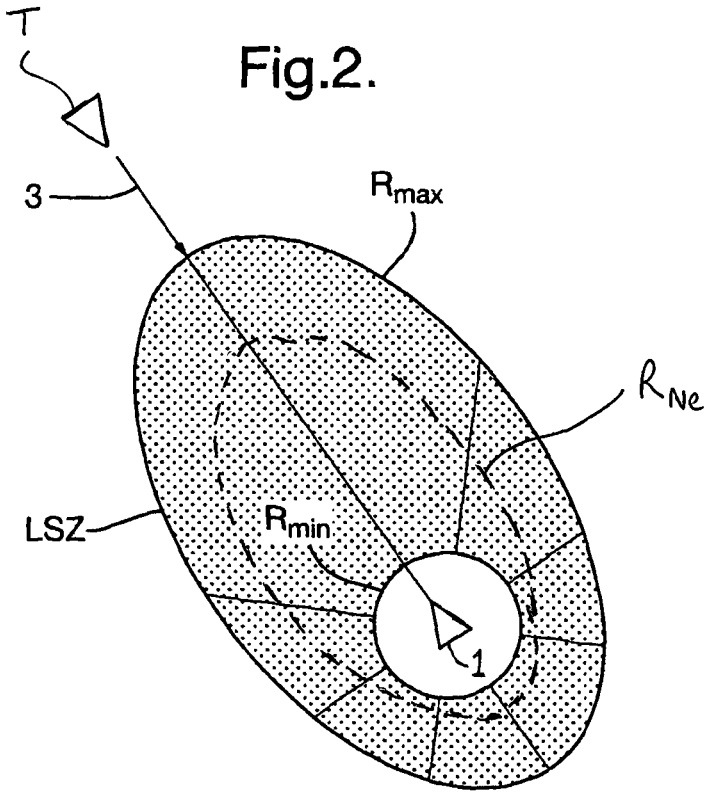
FIG. 2 illustrates the Launch Success Zone (LSZ) for an air to air weapon.

The LSZ shown in FIG. 2 is the region where the probability of an air to air weapon hitting an airborne target T is above a threshold level. Calculation of the LSZ is more complicated than for the LAR, because a greater number of factors are involved, such as the relative velocities and directions of travel of the launch aircraft and the target, and those of the weapon relative to the target. Also, the shape of the LSZ is more complex than that of the LAR; as with the LAR, there are maximum and minimum ranges, $R_{max}$ and $R_{min}$, between which the target T can be successfully engaged, but there is a zone bounded by $R_{min}$ within which the Target T cannot be engaged successfully because it is outside the capability of the weapon to manoeuvre and hit the target when the launch aircraft is so close to the target, given the speeds and directions of travel of the launch aircraft and the target T.

In this embodiment, the LSZ further includes a so-called "no escape range" $R_{Ne}$. The zone bounded by $R_{Ne}$ and $R_{min}$ is a zone in which the likelihood of the Target T successfully evading the weapon is below a threshold likelihood. This range may be determined using performance parameters of the weapon, the launch aircraft 1, and the target T.

As is known in the art, there are two LSZs, one for the launch aircraft to engage the target 7 and the other for the target to engage the launch aircraft.

It is often a requirement to calculate the LAR or LSZ for an engagement to display to the crew of the launch aircraft information regarding the feasibility, or likelihood of success, of the engagement, and to aid fire control and steering decisions. The traditional approach has been to create a simple, abstract model of the weapon that has parameters defined by the launch conditions; this model is then used on board the launch aircraft to generate the LAR, LSZ, or MEZ and the appropriate display.

Figure 3:
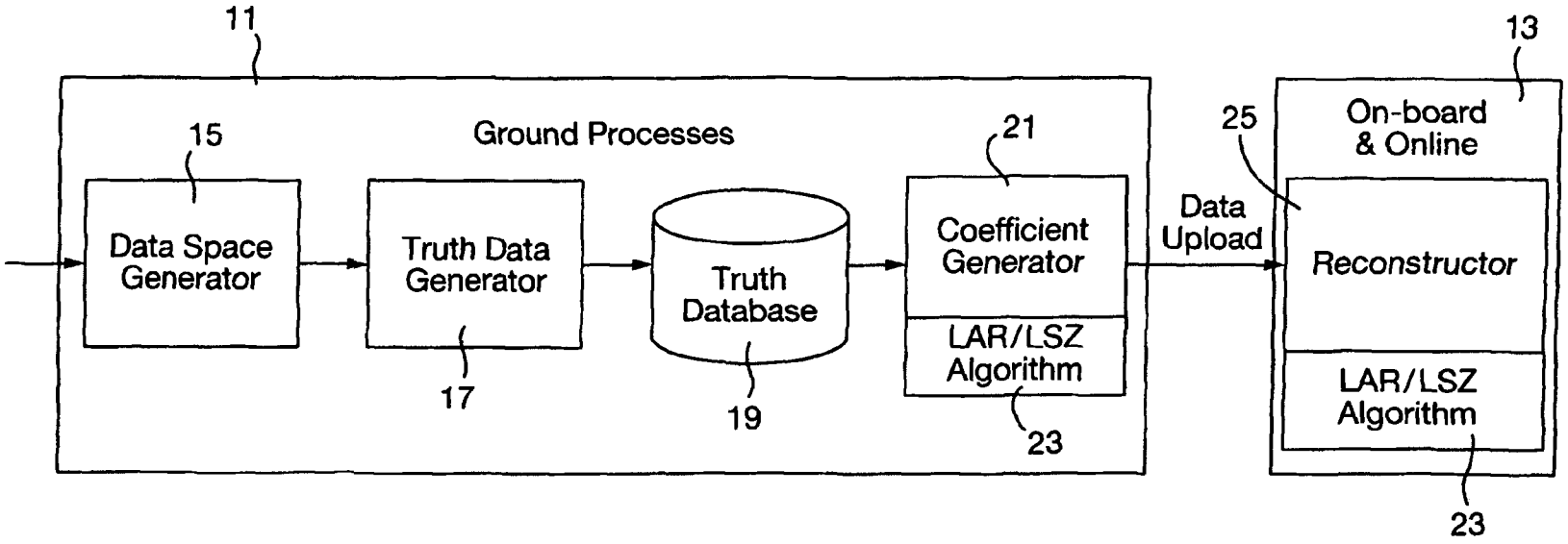
FIG. 3 is a schematic illustration of an embodiment of the present invention.

FIG. 3 shows the system of the present invention schematically, and is divided between those processes 11 which are carried out on the ground and the processes 13 which are carried out on the launch aircraft 1.

The processes begin with the generation of the data space, which is the range of conditions over which the weapon performance envelope is to be defined; this is effected by a data space generator 15, and depends on the ranges of conditions: for which it is required to fire the weapon (which is defined by the weapon user/operator); for which it is feasible to fire according to the launch aircraft capability, and for which it is feasible to fire according to the weapon capability/performance.

In this embodiment, the data space generator 15 comprises data which describes performance parameters for each of a plurality of different aircraft types. Different types of aircraft may have different capabilities from one another, thus, for example, aircraft having the same or similar capabilities may be regarded as being the same "aircraft type". Different types of aircraft may be different models or makes of aircraft and/or may have different manufacturers. Different types of aircraft may have different operational parameters (maximum speed, maximum altitude, g limit, etc.). Different types of aircraft may be configured for different purposes or function (e.g. bombers, fighters, refuelling etc.). These aircraft performance envelopes may be supplied by the aircraft manufacturers or through testing. The plurality of different aircraft types includes the type of the launch aircraft 1 and, preferably, the target aircraft T. The performance parameters for each of the aircraft types may include, but are not limited to, a maximum achievable altitude, a maximum achievable g-force, and a maximum achievable climb angle. The values of the performance parameters for different types of aircraft may be different from one another. For example, a first type of aircraft may have a maximum altitude of 45,000 ft whereas a second type of aircraft may have a maximum altitude of 55,000 ft, and so on.

In this embodiment, the data space generator 15 further comprises data which describes performance parameters for each of a plurality of different weapon types, e.g. different weapons that may be loaded onto to the launch aircraft or may be expected to be carried by a hostile target. These weapon performance envelopes may be supplied by the weapon manufacturers or through testing. The plurality of different weapon types includes the type of the weapon that is carried by the launch aircraft 1 and, preferably, the target. The performance parameters for each of the weapon types may include, but are not limited to, a maximum altitude at which the weapon may be released, a maximum g-force at which the weapon may be released, and release mechanism of the weapon. The values of the performance parameters for different types of weapon may be different from one another. For example, a first type of weapon may be able to be released up to an altitude of 35,000 ft, whereas a second type of weapon may be able to be released up to an altitude of 45,000 ft, and so on.

The data space generator 15 may define the release, weather and commanded impact conditions for training and verification sets which are run by a truth data generator 17.

The truth data generator 17 determines the weapon performance for each firing case in the data space; this depends on the weapon performance model which is usually provided by the weapon manufacturer.

In this embodiment, for each type of weapon, a further weapon performance envelope is determined as follows.

Firstly, a "maximum aircraft performance envelope" is determined using the maximum performance envelope limits across all aircraft types. In other words, for each of the aircraft performance parameters, an envelope for that performance parameter that covers the performance, with respect to that performance, across all the different aircraft types is determined. For example, if, across all aircraft types, the maximum achievable altitude is 55,000 ft, then the maximum aircraft performance envelope has, for the maximum altitude performance parameter, an envelope specifying 0 ft to 55,000 ft (similarly for the other aircraft performance parameters).

In this embodiment the maximum aircraft performance envelope may be expressed as:

$$A=(A_1,A_2,\ldots,A_N)$$

where $$A_i=[(a_{ij})_{min},(a_{ij})_{max}]$$

where: i=1, . . . , N is an index for the aircraft performance parameters, N being the number of aircraft performance parameters;

j=1, . . . , M is an index for the types of aircraft, M being the number of different aircraft types; and $a_{ij}$ is the envelope of the ith aircraft performance parameter of the jth aircraft type, $(a_{ij})_{min}$ being the minimum (over all aircraft types j) of the lower bounds of all envelopes $a_{ij}$, and $(a_{ij})_{max}$ being the maximum (over all aircraft types j) of the upper bounds of all envelopes $a_{ij}$.

The aircraft performance envelope A covers at least the performance envelopes of each of the different types of aircraft.

Secondly, for each weapon type, an "updated" or "further" weapon performance envelope is determined using the initial weapon performance envelope of that weapon type (provided by the weapon supplier and stored in the data space generator 15) and the maximum aircraft performance envelope A. In this embodiment, the further weapon performance envelope for a particular weapon type is the minimum performance envelope (i.e. smallest range of parameter values) that specifies the performance of a weapon of that weapon type being launched from each of the different aircraft types. In this embodiment, for a particular performance parameter, the envelope of that performance parameter as specified in the further weapon performance envelope for a particular weapon type is the minimum performance envelope of that performance parameter specified by the initial weapon performance envelope of that weapon type and the maximum aircraft performance envelope A. For example, for a given weapon type, if the maximum achievable altitude across all the aircraft types is 55,000 ft but the maximum altitude from which that weapon may be released is only 45,000 ft, then the further weapon performance envelope specifies an envelope specifying of 0 ft to 45,000 ft in which that weapon is releasable (similarly for the other aircraft performance parameters).

In this embodiment the further weapon performance envelope for the kth weapon type may be expressed as:

$$W_k=(W_{k1},W_{k2},\ldots,W_{kL})$$

Where $$W_{kl}=[\max((a_{lj})_{min},w_{kl,lower}),\min((a_{lj})_{max},w_{kl,upper})]$$

where: l=1, . . . , L is an index for the weapon performance parameters, L being the number of weapon performance parameters;

k=1, . . . , K is an index for the types of weapon, K being the number of different weapon types; and $w_{kl,lower}$ and $w_{kl,upper}$ are the lower and upper bounds respectively of the envelope of the Ith weapon performance parameter of the kth weapon type.

Thus, the further weapon performance envelope specifies, for a given weapon type, the performance of that weapon when carried by any of the different aircraft types.

The product of the truth data generator 17 is the truth database 19, which is a set of data specifying, for each weapon type, the further weapon performance envelope for each of a plurality of exemplary weapon firings. The truth data generator 17 may produce the training and verification sets which are used by a coefficient generator 21.

Conventionally, the truth database is used as a model which can be employed onboard the launch aircraft in order to generate the feasibility of engagement displays (LAR or LSZ, as appropriate).

In the present invention a coefficient generator 21 receives the further weapon performance envelopes stored by the truth database 19 and calculates, for each weapon type and for each example weapon firing, coefficients according to a generic LAR/LSZ algorithm 23 that "fit" the generic algorithm to the further weapon performance envelope shape.

In some embodiments, the coefficient generator 21 may generate coefficients by building training and verification footprints (representing the target engagement envelope) from data extracted from the truth database, by fitting a geometric shape to the training footprint and by defining the coefficients for the generic algorithm. The coefficient generator may then verify the coefficients against the verification sets by creating footprints based on the coefficients at the verification set conditions and by confirming that these verification footprints meet the criteria for successful engagement.

Figure 4:
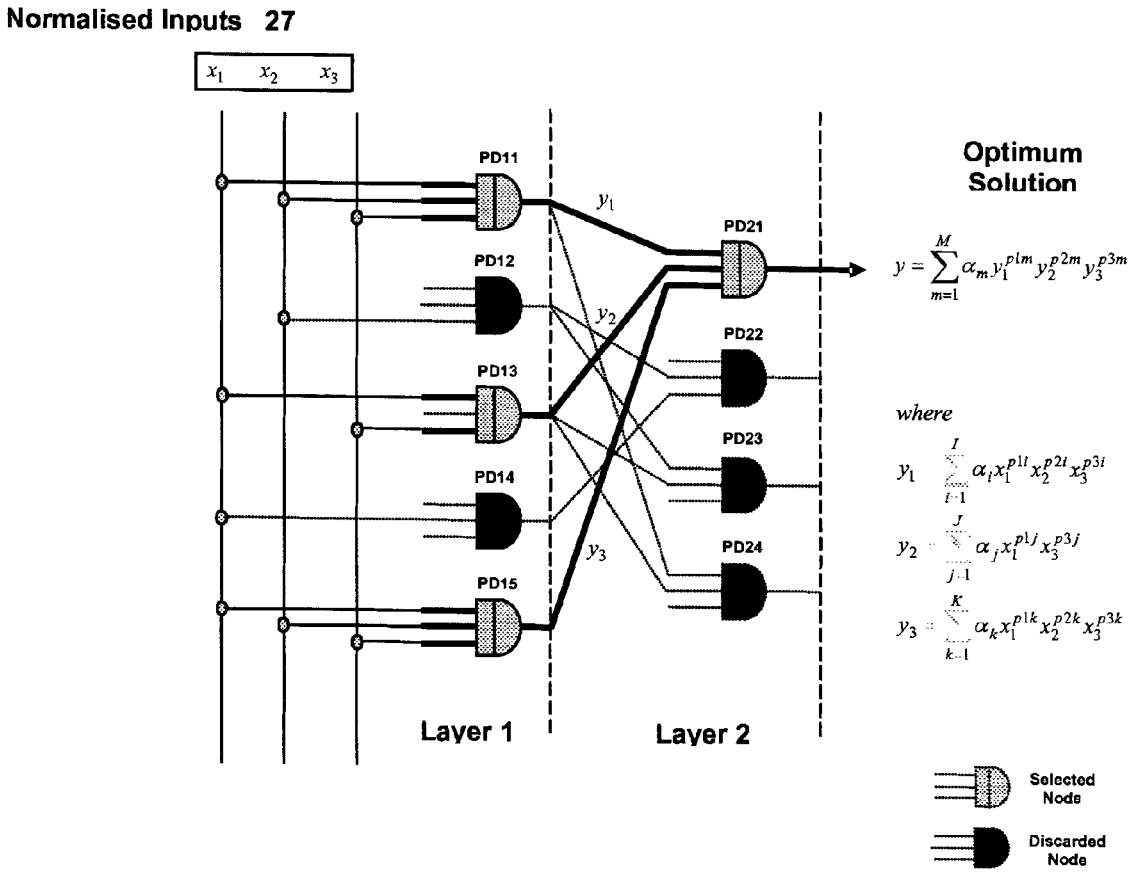
FIG. 4 is a schematic diagram illustrating one embodiment of the coefficient generator technique in accordance with the invention.

In other embodiments, an alternative method of coefficient generation is used as illustrated in FIG. 4. The number of inputs 27 and the form of each polynomial descriptor, $PD^{Layer,\ Node}$, are determined by an optimisation method known as the Genetic Algorithm.

What will now be described is a method of determining coefficient values that fit a generic algorithm to the further weapon performance envelope of a particular weapon type and particular example weapon firing. It will be appreciated that in reality, a set of coefficients is determined for each of the weapon types for each of the example weapon firings.

In this method the coefficient generator 21 starts by creating an initial set of candidate polynomials whose variables are some or all of the weapon or aircraft firing condition parameters. Each of the candidate polynomials is a unique solution the fitting problem. Some or all of the candidate polynomials may have different order, or dimension, from some or all of the other candidate polynomials. For each candidate polynomial, a set of coefficients is then computed that best "fit" that candidate polynomial to the further weapon performance envelope. This may be done using a criterion of least square error or any other fitting method. For each candidate polynomial, a "score" indicative of the quality of this fit is then computed.

The Genetic Algorithm is then applied to the candidate polynomials and scores. In this embodiment, the best scoring polynomials are retained and the other (i.e. worst scoring) polynomials are rejected. New candidate polynomials that have similar features to the retained candidate polynomials are then created to replace the rejected ones (e.g. by "breeding" the retained candidate polynomials). A set of coefficients and score values are then calculated for this new generation of candidates, and so on.

The Genetic Algorithm is repeated until improvement in the scores of the best candidates ceases or some other criteria are satisfied. The result is the first layer, Layer 1, of a Self-Organising Polynomial Neural Network (SOPNN).

The whole process is then repeated with the outputs of the first layer providing the inputs to create a second layer, Layer 2, of the SOPNN. The new layer has the effect of creating higher-order candidate polynomials and coefficients for consideration. The selection of polynomials in the new layer is again governed and optimised by the Genetic Algorithm.

Layers are added to the SOPNN in this way until improvement in the scores of the best candidates ceases or some other criteria are satisfied. A completed network comprising two layers is represented in FIG. 4. The final network is obtained recursively from the path ending at the output node with the best score in the final generation of candidates (the "Optimum Solution"). Any node with no connection to this path is discarded as shown in FIG. 4, where nodes which contribute to the optimal solution are lightly shaded and discarded nodes are black.

The best single candidate polynomial and coefficient set is identified and stored. This process is repeated until all the required characteristics of the LAR/LSZ have corresponding polynomial models. In other words, the process is repeated until, for each firing condition, and for each weapon type, a polynomial model fitted to the further weapon performance envelope for that weapon type and firing condition is generated.

The generic LAR/LSZ algorithm is predetermined, and in the present invention is a polynomial equation of the form:

$$y_n = \sum_{m=1}^{M_n} \alpha_{mn} x_1^{p_{1mn}} x_2^{p_{2mn}} \ldots$$

Where:

$\alpha_{mn}$ represent the m coefficients required to compute output n;

$\{x_1 \ldots x_{Ni}\}$ represent the normalised inputs; and $\{y_1 \ldots y_{Nj}\}$ represent the outputs.

Preferably, the order of the generic LAR/LSZ algorithm is three or greater. More preferably, the order of the generic algorithm is between 10 and 25. More preferably, the order of the generic algorithm is 20. Surprisingly, it has been found that using a generic algorithm with an order of around 20 adequately describes most air-to-air engagements accurately in an appropriate runtime for on-aircraft implementation. Nevertheless, the generic LAR/LSZ algorithm may have an order greater than 2.

Referring again to FIG. 3, the output of the coefficient generator 21 is the set of coefficients which is loaded onto the launch aircraft by a data uploader. Following this step, the onboard processes 13 comprise a reconstructor 25, which brings together the generic LAR/LSZ algorithm 23 (which is held in the aircraft systems) and the uploaded coefficients, so as to reconstruct the LAR, LSZ, or MEZ for a particular engagement by selecting the appropriate algorithm and coefficients for the current launch conditions (i.e. the weapon or aircraft firing conditions). The weapon or aircraft firing condition parameters may include, but are not limited to, parameters such as aircraft velocities, aircraft height, aircraft attitude, slant range to target, target velocities, target height, line of sight azimuth, target pitch and aspect angles, and wind speed. The weapon or aircraft firing condition parameters may include, but are not limited to relative velocities and directions of travel of the launch aircraft and the target and those of the weapon relative to the target.

Once the LAR, LSZ, or MEZ has been reconstructed for a particular engagement by the systems onboard the aircraft, the LAR, LSZ, or MEZ is displayed by conventional means onboard the aircraft.

In this embodiment, in operation, when the launch aircraft 1 engages with a hostile target aircraft T, the reconstructor 25 onboard the launch aircraft 1 may select, from the uploaded coefficients, those coefficients that correspond to the weapon being carried by the launch aircraft 1 and that correspond to the relevant firing condition (altitude, angle of attack, environmental conditions, g-force being experienced etc.). The selected coefficients may then be used to reconstruct the LSZ of the launch aircraft 1 for display to the pilot of the launch aircraft 1. The reconstructed LSZ of the launch aircraft 1 may also be used by other systems onboard the launch aircraft 1 to recommend actions to the pilot of the launch aircraft 1 (e.g. a recommendation that the weapon is fired etc.).

Also when the launch aircraft 1 engages with a hostile target aircraft T, the aircraft type of the hostile target T may be determined by the pilot of the launch aircraft 1 (or by other means) and input to the reconstructor 25. The reconstructor 25 onboard the launch aircraft 1 may then select, from the uploaded coefficients, those coefficients that correspond to the weapon most likely being carried by the hostile target T and that correspond to the relevant firing conditions. The selected coefficients may then be used to reconstruct the LSZ of the hostile target T for display to the pilot of the launch aircraft 1. The reconstructed LSZ of the hostile target T may also be used by other systems onboard the launch aircraft 1 to recommend actions to the pilot of the launch aircraft 1 (e.g. a recommendation that certain evasive manoeuvres are performed etc.).

In this embodiment, in operation, when the launch aircraft 1 engages with a hostile ground target 5, the reconstructor 25 on-board the launch aircraft 1 may select, from the uploaded coefficients, those coefficients that correspond to the weapon being carried by the launch aircraft 1 and that correspond to the relevant firing condition (altitude, angle of attack, environmental conditions, g-force being experienced etc.). The selected coefficients may then be used to reconstruct the LAR of the launch aircraft 1 for display to the pilot of the launch aircraft 1. The reconstructed LAR of the launch aircraft 1 may also be used by other systems onboard the launch aircraft 1 to recommend actions to the pilot of the launch aircraft 1 (e.g. a recommendation that the weapon is fired etc.).

Also when the launch aircraft 1 engages with a hostile ground target 5, the type of the ground target 5 may be determined by the pilot of the launch aircraft 1 (or by other means) and input to the reconstructor 25. The reconstructor 25 onboard the launch aircraft 1 may then select, from the uploaded coefficients, those coefficients that correspond to the weapon most likely being carried by the ground target 5 and that correspond to the relevant firing conditions. The selected coefficients may then be used to reconstruct the MEZ of the ground target 5 for display to the pilot of the launch aircraft 1. The reconstructed MEZ of the ground target 5 may also be used by other systems onboard the launch aircraft 1 to recommend actions to the pilot of the launch aircraft 1 (e.g. a recommendation that certain evasive manoeuvres are performed etc.).

In the present invention, a single algorithm allows the rapid change between different weapons payloads simply by uploading a set of data representing the coefficients applicable to the new weapon.

Apparatus, including the any of the above mentioned processors, for implementing the above described arrangement, may be provided by configuring or adapting any suitable apparatus, for example one or more computers or other processing apparatus or processors, and/or providing additional modules. The apparatus may comprise a computer, a network of computers, or one or more processors, for implementing instructions and using data, including instructions and data in the form of a computer program or plurality of computer programs stored in or on a machine readable storage medium such as computer memory, a computer disk, ROM, PROM etc., or any combination of these or other storage media.

Advantageously, the above described generic polynomial/algorithm may be used (e.g. simultaneously) by multiple different types of aircraft. In other words, different types of aircraft may use the same generic algorithm to calculate LARs/LSZs. Also, the same generic algorithm may be used to calculate LARs/LSZs for different weapon types. Thus, aircraft software comprising the generic polynomial and means for allowing loading of coefficients for each weapon loaded on aircraft is produced only once. The software algorithm and coefficients, for any given weapon, are the same for any aircraft type. This tends to be different to conventional methodologies in which, although common tools may be used for polynomial and coefficient generation, both the software (including an algorithm/polynomial) and coefficients are generated for every weapon type and every time the weapon performance is changed. This need to rewrite the software and the certification of it tends to be particularly costly. The above described method and system advantageously tend to provide that the aircraft software does not have to be rewritten and hence no new certification is required.

In some embodiments, each aircraft within a fleet comprising a plurality of different aircraft is loaded with the same, common generic polynomial. When a weapon is loaded onto an aircraft in the fleet, the specific coefficients corresponding to that weapon may also be loaded onto that aircraft. This tends to be in contrast to conventional systems in which, although the tools for generating LAR/LSZs may be common across multiple different aircraft, when a weapon is loaded onto an aircraft, both a polynomial/algorithm and corresponding coefficients for generating LAR/LSZs are generated for that aircraft and weapon load-out.

The invention claimed is:

1. A method for generating, in an aircraft in flight, a display indicative of the feasibility of a weapon carried on the aircraft successfully engaging a target and/or the feasibility of a weapon carried on the target successfully engaging the aircraft, the method comprising:

acquiring, by one or more processors, a respective performance envelope for one or more different types of aircraft, the one or more processors being remote from the aircraft;

using the one or more aircraft performance envelopes, determining, by the one or more processors, a performance envelope defining the performance of all of the different aircraft types;

acquiring, by the one or more processors, a performance envelope for the weapon;

using the weapon performance envelope and the performance envelope that is representative of the performance of all of the different aircraft types, determining, by the one or more processors, a further performance envelope, the further performance envelope defining the weapon's performance when that weapon is implemented on each of the different aircraft types, the further performance envelope being the minimum envelope that defines the weapon's performance when that weapon is implemented on each of the different aircraft types;

determining, by the one or more processors, coefficients for a generic polynomial that fit the generic polynomial to the further performance envelope;

uploading, to the aircraft, the generated coefficients;

reconstructing, on the aircraft, the further performance envelope using the same generic polynomial; and using aircraft and target conditions and the reconstructed further performance envelope, generating, on the aircraft, the feasibility display.

2. A method according to claim 1, wherein the step of acquiring a respective performance envelope for one or more different types of aircraft comprises acquiring a respective performance envelope for a plurality of different types of aircraft.

3. A method according to claim 1, wherein the generic polynomial is of the form:

$$y_n = \sum_{m=1}^{M_n} \alpha_{mn} x_1^{p1mn} x_2^{p2mn} \ldots$$

where:

$\alpha_{mn}$ represent the m coefficients required to compute output n;

$\{x_1 \ldots x_{Ni}\}$ represent the normalised inputs; and $\{y_1 \ldots y_{Ni}\}$ represent outputs.

4. A method according to claim 1, wherein the order of the generic polynomial is three or greater.

5. A method according to claim 4, wherein the order of the generic polynomial is between 10 and 25.

6. A method according to claim 5, wherein the order of the generic polynomial is 20.

7. A method according to claim 1, wherein the step of generating the coefficients comprises:

generating an initial population of candidate polynomials;

for each candidate polynomial, computing a set of coefficients which fit that polynomial to the further performance envelope according to one or more criteria;

for each candidate polynomial and respective set of coefficients, computing a score function indicative of the quality of the fit of that candidate polynomial and that set of coefficients to the further performance envelope; and recursively applying a genetic algorithm to the set of candidate polynomials until one or more criteria are met, including retaining at least the best scoring polynomial and discarding the other polynomials, said retained polynomials having inputs and outputs.

8. A method according to claim 7 wherein the outputs of the retained polynomials are a layer of a Self-Organising Polynomial Neural Network and are used to provide inputs for creating higher order candidate polynomials.

9. A method according to claim 8, further comprising:

iterating on the higher order candidate polynomials the steps of:

generating an initial population of candidate polynomials;

for each candidate polynomial, computing a set of coefficients which fit that polynomial to the further performance envelope according to one or more criteria;

for each candidate polynomial and respective set of coefficients, computing a score function indicative of the quality of the fit of that candidate polynomial and that set of coefficients to the further performance envelope; and recursively applying a genetic algorithm to the set of candidate polynomials until one or more criteria are met, including retaining at least the best scoring polynomial and discarding the other polynomials, wherein the outputs of the retained polynomials are a layer of a Self-Organising Polynomial Neural Network and are used to provide inputs for creating higher order candidate polynomials; and obtaining a final result recursively from the path ending with the best candidate score.

10. A method according to claim 1, wherein:

the target is a further aircraft and the feasibility display is indicative of a Launch Success Zone of the aircraft and/or the target; or the target is a ground based target and the feasibility display is indicative of a Launch Acceptability Region of the aircraft and/or a Missile Engagement Zone of the target.

11. A system for generating in an aircraft in flight a display indicative of the feasibility of a weapon carried on the aircraft successfully engaging a determined target and/or the feasibility of a weapon carried on the target successfully engaging the aircraft, the system comprising:

one or more processors remote from the aircraft and configured to:

acquire a respective performance envelope for one or more different types of aircraft;

using the one or more aircraft performance envelopes, determine a performance envelope defining the performance of all of the different aircraft types;

acquire a performance envelope for the weapon;

using the weapon performance envelope and the performance envelope that is representative of the performance of all of the different aircraft types, determine a further performance envelope, the further performance envelope defining the weapon's performance when that weapon is implemented on each of the different aircraft types, the further performance envelope being the minimum envelope that defines the weapon's performance when that weapon is implemented on each of the different aircraft types; and determine coefficients for a generic polynomial that fit the generic polynomial to the further performance envelope;

an uploader operatively coupled to the one or more processors and configured to upload, to the aircraft, the generated coefficients; and a reconstructor onboard the aircraft and configured to:

reconstruct the further performance envelope using the same generic polynomial; and using aircraft and target conditions and the reconstructed further performance envelope, generate, on the aircraft, the feasibility display.

12. A system according to claim 11, wherein the one or more processors are configured to acquire a respective performance envelope for a plurality of different types of aircraft.

13. An aircraft comprising a system for generating in an aircraft in flight a display indicative of the feasibility of a weapon carried on the aircraft successfully engaging a determined target and/or the feasibility of a weapon carried on the target successfully engaging the aircraft, the system comprising:

one or more processors remote from the aircraft and configured to:

acquire a respective performance envelope for one or more different types of aircraft;

using the one or more aircraft performance envelopes, determine a performance envelope defining the performance of all of the different aircraft types;

acquire a performance envelope for the weapon;

using the weapon performance envelope and the performance envelope that is representative of the performance of all of the different aircraft types, determine a further performance envelope, the further performance envelope defining the weapon's performance when that weapon is implemented on each of the different aircraft types, the further performance envelope being the minimum envelope that defines the weapon's performance when that weapon is implemented on each of the different aircraft types; and determine coefficients for a generic polynomial that fit the generic polynomial to the further performance envelope;

an uploader operatively coupled to the one or more processors and configured to upload, to the aircraft, the generated coefficients; and a reconstructor onboard the aircraft and configured to:

reconstruct the further performance envelope using the same generic polynomial; and using aircraft and target conditions and the reconstructed further performance envelope, generate, on the aircraft, the feasibility display.

14. A program or plurality of programs arranged such that when executed by a computer system or one or more processors it/they cause the computer system or the one or more processors to generate, in an aircraft in flight, a display indicative of the feasibility of a weapon carried on the aircraft successfully engaging a target and/or the feasibility of a weapon carried on the target successfully engaging the aircraft, according to a method comprising:

acquiring, by one or more processors, a respective performance envelope for one or more different types of aircraft, the one or more processors being remote from the aircraft;

using the one or more aircraft performance envelopes, determining, by the one or more processors, a performance envelope defining the performance of all of the different aircraft types;

acquiring, by the one or more processors, a performance envelope for the weapon;

using the weapon performance envelope and the performance envelope that is representative of the performance of all of the different aircraft types, determining, by the one or more processors, a further performance envelope, the further performance envelope defining the weapon's performance when that weapon is implemented on each of the different aircraft types, the further performance envelope being the minimum envelope that defines the weapon's performance when that weapon is implemented on each of the different aircraft types;

determining, by the one or more processors, coefficients for a generic polynomial that fit the generic polynomial to the further performance envelope;

uploading, to the aircraft, the generated coefficients;

reconstructing, on the aircraft, the further performance envelope using the same generic polynomial; and using aircraft and target conditions and the reconstructed further performance envelope, generating, on the aircraft, the feasibility display.

15. A non-transitory machine readable storage medium storing a program that is executable by a computing system for generating, in an aircraft in flight, a display indicative of at least one of the feasibility of a weapon carried on the aircraft successfully engaging a target, and the feasibility of a weapon carried on the target successfully engaging the aircraft, the program comprising instructions for executing a method that includes:

acquiring, by one or more processors, a respective performance envelope for one or more different types of aircraft, the one or more processors being remote from the aircraft;

using the one or more aircraft performance envelopes, determining, by the one or more processors, a performance envelope defining the performance of all of the different aircraft types;

acquiring, by the one or more processors, a performance envelope for the weapon;

using the weapon performance envelope and the performance envelope that is representative of the performance of all of the different aircraft types, determining, by the one or more processors, a further performance envelope, the further performance envelope defining the weapon's performance when that weapon is implemented on each of the different aircraft types, the further performance envelope being the minimum envelope that defines the weapon's performance when that weapon is implemented on each of the different aircraft types;

determining, by the one or more processors, coefficients for a generic polynomial that fit the generic polynomial to the further performance envelope;

uploading, to the aircraft, the generated coefficients;

reconstructing, on the aircraft, the further performance envelope using the same generic polynomial; and using aircraft and target conditions and the reconstructed further performance envelope, generating, on the aircraft, the feasibility display.

* * * * *